US007404401B1

(12) United States Patent
Brady

(10) Patent No.: US 7,404,401 B1
(45) Date of Patent: Jul. 29, 2008

(54) WATER RESPIRATOR FILTER

(76) Inventor: Marlon Brady, 2093 San Jose Blvd., Orlando, FL (US) 32808

( * ) Notice: Subject to any disclaimer, the term of this patent is extended or adjusted under 35 U.S.C. 154(b) by 559 days.

(21) Appl. No.: 11/150,536

(22) Filed: Jun. 10, 2005

(51) Int. Cl.
*A62B 7/10* (2006.01)
*A62B 23/02* (2006.01)
*A62B 18/08* (2006.01)
*A62B 19/00* (2006.01)

(52) U.S. Cl. ..... 128/206.17; 128/205.29; 128/205.27; 128/206.12

(58) Field of Classification Search ..... 128/206.15, 128/207.11, 206, 206.17, 200.13, 201.13, 128/206.12, 206.18, 206.19, 205.27, 206.16, 128/202.27, 205.29
See application file for complete search history.

(56) References Cited

U.S. PATENT DOCUMENTS 1,948,945 A 2/1934 Seijo
2,008,677 A * 7/1935 Booharin ..... 128/206.15
2,088,720 A 8/1937 Poliniak
2,151,792 A * 3/1939 Myers et al. ..... 423/210
3,140,590 A * 7/1964 Gleockler ..... 62/259.3
3,980,080 A * 9/1976 Muto ..... 128/200.13
4,146,026 A 3/1979 Montalvo
4,304,230 A * 12/1981 Seufert ..... 128/206.17
4,705,033 A 11/1987 Halfpenny
5,411,021 A * 5/1995 Gdulla et al. ..... 128/206.28
5,848,592 A * 12/1998 Sibley ..... 128/205.27
D440,301 S 4/2001 Fecteau et al.
D477,401 S 7/2003 Petherbridge et al.

* cited by examiner

*Primary Examiner*—Justine R Yu
*Assistant Examiner*—Kristen C Matter
(74) *Attorney, Agent, or Firm*—Lawrence J. Gibney, Jr.

(57) ABSTRACT

This water respirator filter will allow the individual who is working in dangerous environments to be able to filter air through a water and solid filtering media. The first stage allows the air to pass through the liquid filtering media, such as water, and then pass through a solid filtering media, such as cotton or cellulose.

4 Claims, 3 Drawing Sheets

WATER RESPIRATOR FILTER

BACKGROUND OF THE INVENTION

A. Field of the Invention

This relates to the filtering of air particularly in areas such as chemical plants, where the concentration of chemicals, fumes or other airborne hazards are present.

B. Prior Art

There are many other prior art references to masks and masks that filter. Representative examples of these include Montalvo, U.S. Pat. No. 4,146,026, Muto U.S. Pat. No. 3,980,080 and Halfpenny U.S. Pat. No. 4,705,033.

In the present application the device uses both a water or liquid filtration media as well as a solid filtration media. None of the prior patents use those particular media combinations. Montalvo does employ the use of water as does Poliniak, U.S. Pat. No. 2,088,720.

The combination liquid filtration media as well as the solid filtration media give it an added filtration quality to the user.

As such the structural differences between the two are significant.

BRIEF SUMMARY OF THE INVENTION

This is a respiration mask, which will be used in areas of high concentration of pollutants such as chemicals and smoke where it will be difficult for an individual to breathe.

This is not a forced air mask, but instead filters the air as the individual is breathing the air.

The filter would be attached to the individual like most respirator filters with straps around the neck and head areas. On the front of the device will be two separate canisters partially filled with water on one side and partially filled with a filtration media, such as cellulose or cotton on the other to filter particles such as soot and dirt. A check valve would connect the two cavities together and prevent the water from contaminating the solid filtering media.

A plate with holes on the interior surface of the respective canisters would allow the air to be inhaled by the individual wearing the mask.

The two canisters, which filter the air are positioned on the sides of the front of the mask.

In the center of the mask would be a central exhalation port, which would allow the exhaled air to exit the mask. A check valve is placed between the user and the exhalation holes and ensures that the individual does not inhale smoke or other chemicals during the inhalation process while at the same time permitting the exhaled air to leave the mask.

NUMBERING REFERENCE

Figure 1:
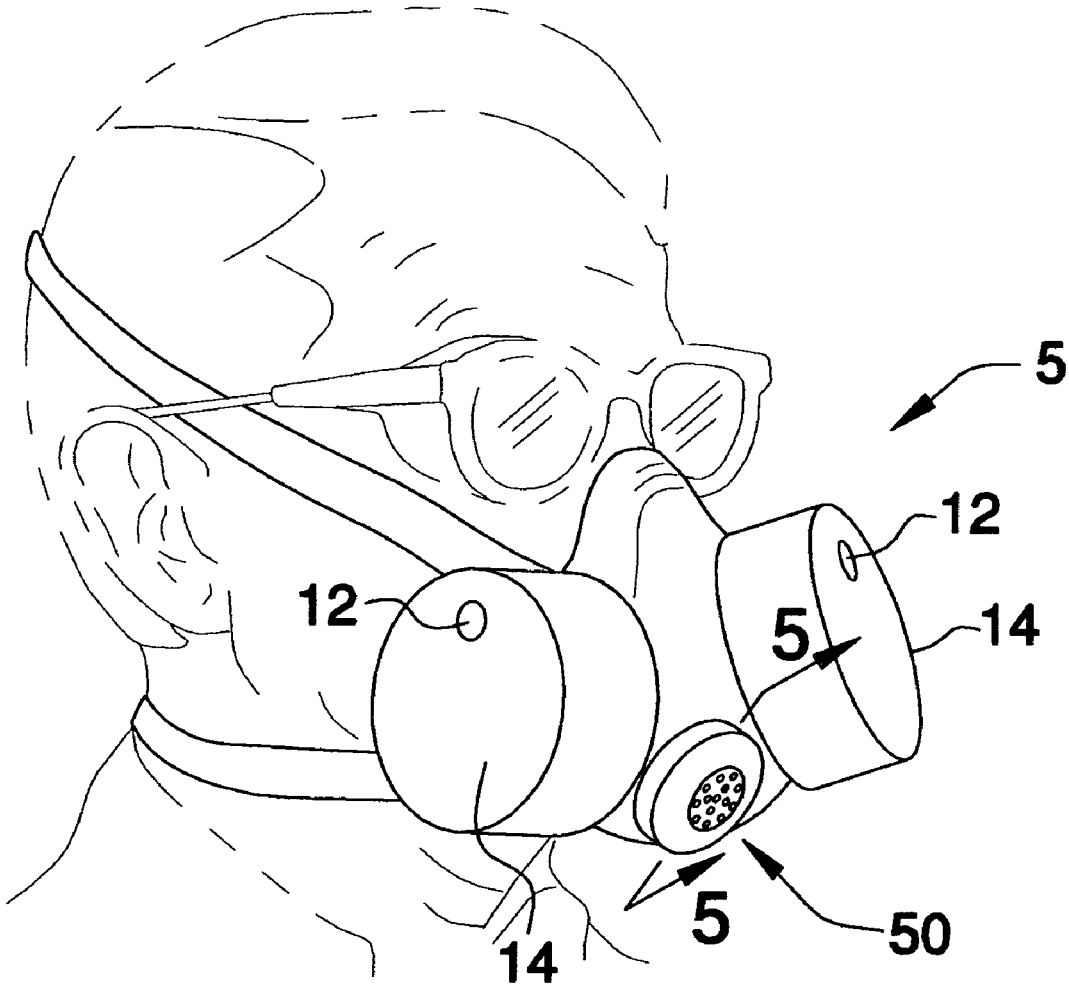
FIG. 1 is an isometric view of the device installed on an individual's face.
Figure 2:
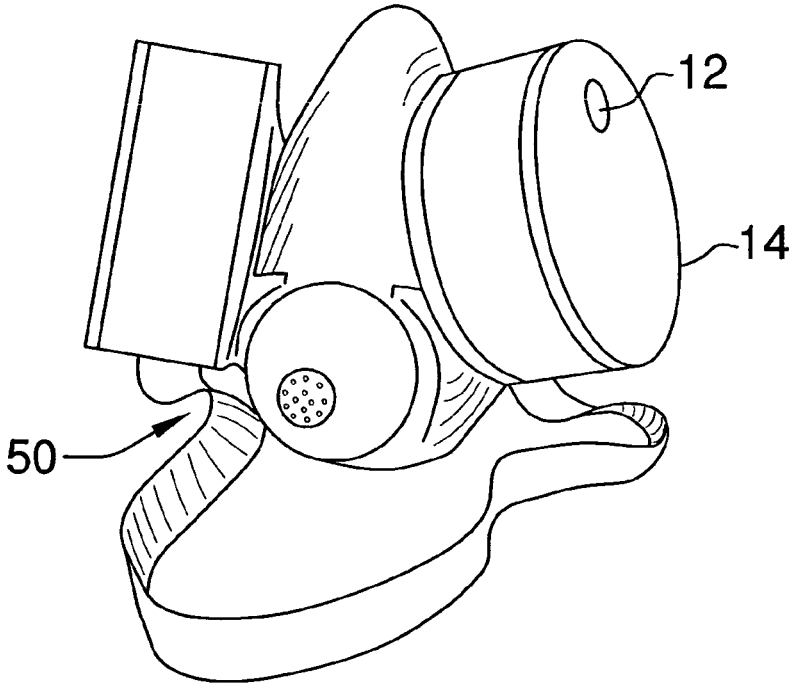
FIG. 2 is an isometric view of the device standing alone.
Figure 3:
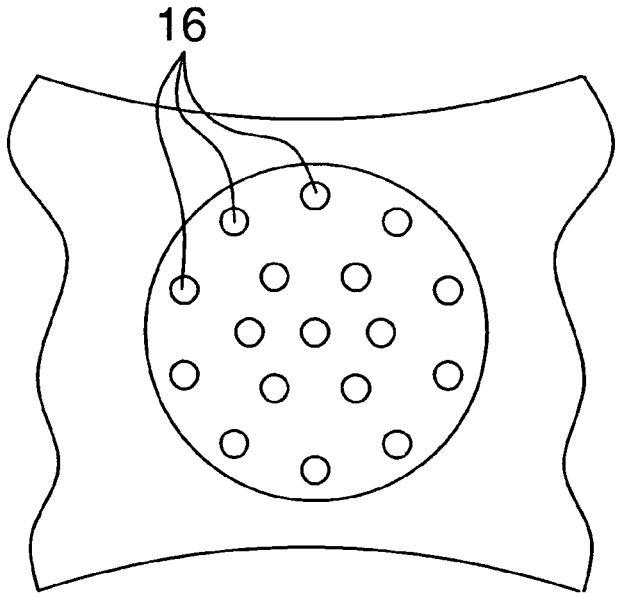
FIG. 3 is a rear view of the central inhalation unit.
Figure 4:
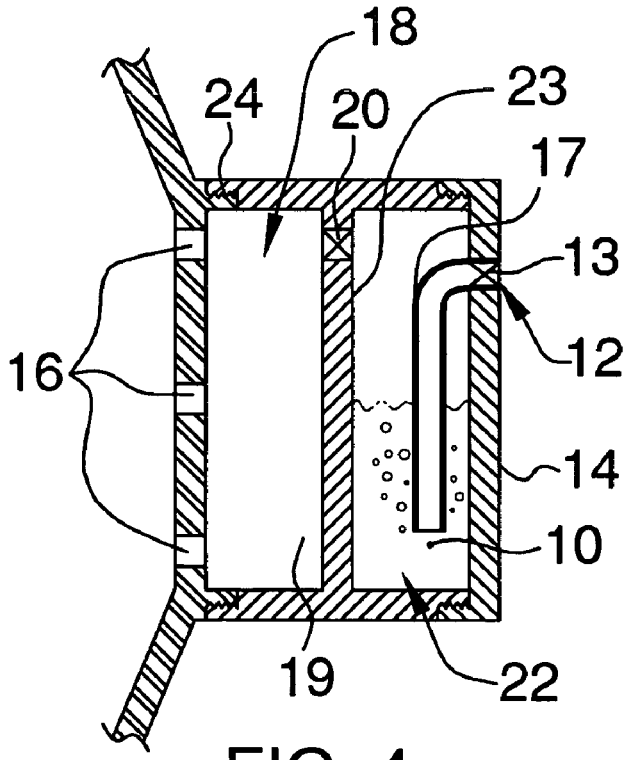
FIG. 4 is a cross sectional view of the canister.
Figure 5:
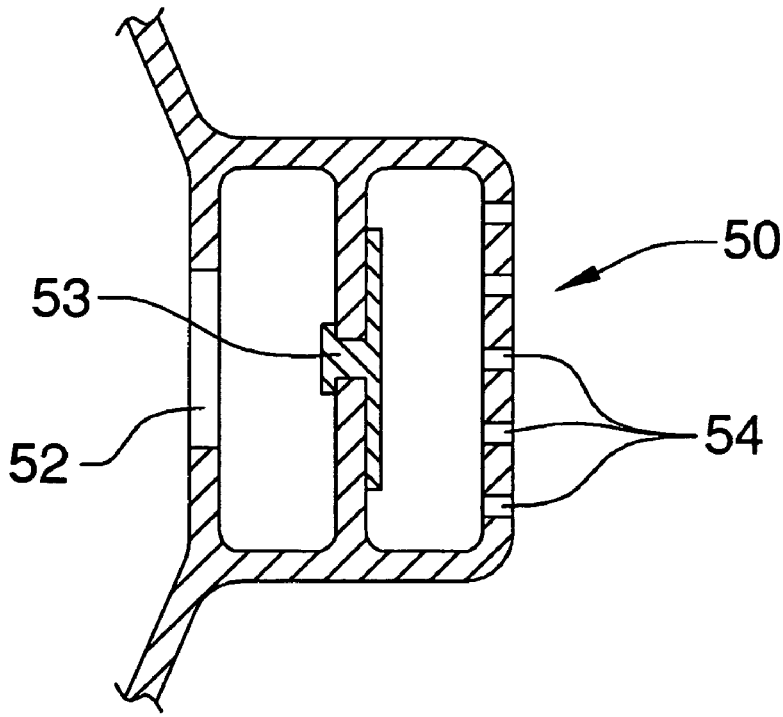
FIG. 5 is a view according to line 5-5 on FIG. 1.

| | |
|---|---|
| 5 | Device |
| 10 | Water |
| 12 | Inhalation hole |

-continued

| | |
|---|---|
| 13 | Exterior Check valve |
| 14 | Filtration canister |
| 16 | Inhalation Holes |
| 17 | Tube |
| 18 | Solid Filtration Cavity |
| 19 | Solid Filtration Media |
| 20 | Interior Check valve |
| 22 | Liquid Filtration Cavity |
| 23 | Partition |
| 24 | Threads |
| 50 | Exhalation port |
| 52 | Opening |
| 53 | Check valve |
| 54 | Exhalation Holes |

DETAILED DESCRIPTION OF THE EMBODIMENT

The device 5 is an air filtration device using a first cavity with water and a second cavity using a filtering media to remove particles such as dirt and soot. This device will be used when a strong presence of chemicals, smoke or other airborne irritants is present. It will protect the individual user from inhaling dangerous chemicals or smoke. The unit is installed on the individual's face as a typical air mask or air filtration device. This is not a forced air mask.

The device 5 would be placed over the individual's nose and mouth and have two filtration canisters 14, which are positioned on opposite sides of the front of the device. In the center would be an exhalation port 50.

Within the filtration canisters 14 are two cavities: a liquid filtration cavity 22 and a solid filtration cavity 18. The liquid filtration cavity 22 is filled partially with a fluid such as water 10 to initially remove sediment and other airborne particulates from the air. The solid filtration cavity contains the solid filtering media and is used to provide a second stage of filtration. A solid partition 23 separates the liquid filtration cavity 22 from the solid filtration cavity 18.

A tube 17 allows the air from the outside to enter the liquid filtration cavity 22. One end of the tube 17 will be immersed in the liquid 10. An exterior check valve 13 is placed on the exterior surface of the filtration canister 14 to prevent the liquid from spilling out of the liquid filtration cavity while at the same time allowing a stream of air to enter the liquid filtration cavity 22. The air would pass through the check valve 13 and through the tube 12 into the liquid 10.

The air would be partially filtered by the liquid 10 and then would travel to an interior check valve 20 which has been placed in the partition 23 between the two cavities. The air would pass from the liquid filtration cavity 22 into the solid filtration cavity 18 by passing through the interior check valve 20. A solid filtration media 19 will be placed in the solid filtration cavity 18 to provide a second stage of filtration using a solid substance that will allow air flow but which is not a liquid. Typical examples of the solid filtration media may include cotton, cellulose, or other type of material to remove soot and other debris from the air.

After the solid filtering media 19 filters the air, the air then passes through a series of inhalation holes 16 on the interior surface of the filtering canisters to the user.

The two filtration canisters 14 would be threaded onto the outer surface of the mask 24 to allow the user to change the solid filtering media 19. Additionally, the outer surface of the filtration canister 14 would also be threaded to change the liquid 10 or service the exterior check valve 13 or the interior check valve 20.

As the person exhales, the exhaled air passes through a an opening 52 in the exhalation port 50. The exhalation port 50 is on the front of the device 5 and placed between the two filtration canisters 14. A check valve 53 is installed within the exhalation port 50 to ensure that the individual does not accidentally inhale airborne irritants through the exhalation port but at the same time the check valve 53 allows the free flow of exhaled air through the opening 52 and the holes 54 on the outside of the exhalation port 50.

The invention claimed is:

1. A water respiration filter, which is comprised of:

a plurality of filtration canisters threaded to an outside surface of a mask, each filtration canister being divided into a liquid filtration cavity and a solid filtration cavity separated by a partition, said liquid filtration cavity containing a predetermined amount of liquid and being equipped with a tube that allows outside air to travel into the liquid filtration cavity, said solid filtration cavity containing a solid filtration media;

wherein each filtration canister further comprises:

an exterior check valve placed in the tube leading to the liquid filtration cavity;

an interior check valve placed in the partition between the liquid and solid filtration cavities;

a plurality of inhalation holes placed on an interior surface of the solid filtration cavity to allow the filtered air to pass to an individual;

an exhalation port placed on a front surface of the mask;

an opening for allowing the individual to exhale into the exhalation port;

a check valve installed in a body of the exhalation port; and a plurality of exhalation holes for allowing exhaled air to pass through to the outside environment.

2. The device as described in claim 1 wherein the solid filtration media is cellulose.

3. The device as described in claim 1 wherein the solid filtration media is cotton.

4. The device as described in claim 1 wherein the liquid filtration media is a predetermined amount of water.

* * * * *